US005268724A

United States Patent [19]

Koizumi et al.

[11] Patent Number: 5,268,724

[45] Date of Patent: Dec. 7, 1993

[54] TRANSFER APPARATUS PROVIDING IMPROVED TRANSFER MATERIAL GUIDANCE ALONG A FEED PATH TO AN ELECTROPHOTOGRAPHIC IMAGE CARRIER

[75] Inventors: Hiromitsu Koizumi; Yukinori Sezaki, both of Saitama, Japan

[73] Assignee: Fuji Xerox Co., Ltd., Tokyo, Japan

[21] Appl. No.: 979,419

[22] Filed: Nov. 19, 1992

Related U.S. Application Data

[63] Continuation of Ser. No. 686,938, Apr. 18, 1991, abandoned.

[30] Foreign Application Priority Data

Apr. 20, 1990 [JP] Japan ..... 2-103035

[51] Int. Cl.[5] ..... G03G 15/16

[52] U.S. Cl. ..... 355/274; 271/251; 271/264; 355/321

[58] Field of Search ..... 355/271, 274, 308, 309, 355/315, 321; 361/212, 214; 271/18, 18.1, 193, 251, 264

[56] References Cited

U.S. PATENT DOCUMENTS

| | | | |
|---|---|---|---|
| 4,110,027 | 8/1978 | Sato et al. | 355/274 |
| 4,338,017 | 7/1982 | Nishikawa | 355/272 |
| 4,396,273 | 8/1983 | Matsuyama et al. | 355/274 |
| 4,417,800 | 11/1983 | Hirose et al. | 355/315 |
| 4,478,506 | 10/1984 | Miyoshi et al. | 355/271 |
| 4,491,407 | 1/1985 | Mitsuyama et al. | 355/274 |
| 4,579,447 | 4/1986 | Kato | 355/311 |
| 4,699,499 | 10/1987 | Hoshika et al. | 355/274 |
| 4,739,362 | 4/1988 | Kau et al. | 355/277 |
| 4,847,652 | 7/1989 | Masuda et al. | 355/274 |
| 4,933,723 | 6/1990 | Kakuta et al. | 355/271 |
| 4,978,998 | 12/1990 | Aizawa | 355/273 |

FOREIGN PATENT DOCUMENTS

| | | | |
|---|---|---|---|
| 0209552 | 9/1987 | Japan | 355/271 |
| 0084268 | 3/1989 | Japan | 355/271 |

OTHER PUBLICATIONS

Abstract of Japan Application No. 60-4969, vol. 9, No. 120.

*Primary Examiner*—Leo P. Picard
*Assistant Examiner*—Christopher Hogan
*Attorney, Agent, or Firm*—Finnegan, Henderson, Farabow, Garrett & Dunner

[57] ABSTRACT

A transfer apparatus including a photoreceptor drum having a transfer position, feeding rollers for feeding out a sheet of paper upward obliquely, and a guide member provided between the feeding rollers and the photoreceptor drum and having a guide surface on a lower surface thereof to guide the paper to the transfer position along the guide surface. In the transfer apparatus, the structure is simplified since the paper is guided by the single guide member. Moreover, the feeding of the paper can be performed smoothly, since frictional resistance is produced only on one side of the paper. In addition, the guide surface is formed on the lower surface of the guide member, so that the paper can be supplied to the transfer position of the photoreceptor drum stably.

4 Claims, 2 Drawing Sheets

TRANSFER APPARATUS PROVIDING IMPROVED TRANSFER MATERIAL GUIDANCE ALONG A FEED PATH TO AN ELECTROPHOTOGRAPHIC IMAGE CARRIER

This application is a continuation of application Ser. No. 07/686,938, filed Apr. 18, 1991, now abandoned.

BACKGROUND OF THE INVENTION

The present invention relates to a transfer apparatus for use in an image forming system of an electrophotography system, and particularly relates to a transfer apparatus having an improved guide member for guiding a transfer material, such as paper, to a transfer position.

Recently an image forming system in which an electrostatic latent image is formed on an image carrier such as a photoreceptor drum, developed and transferred onto a transfer material such as paper by means of a transfer apparatus, has been put into a practical use widely. Generally, in a transfer apparatus for use in such an image forming system, a feeding mechanism is provided on the upstream side of the photoreceptor drum, and a paper guide member for guiding paper to a transfer position on the photoreceptor drum is provided between this feeding mechanism and the photoreceptor drum.

As a conventional transfer apparatus provided with such a paper guide member, for example, there is one disclosed in Japanese Patent Unexamined Publication No. Sho. 58-10767. In this transfer apparatus, the paper guide member is constituted by a pair of guide members provided vertically in opposition to each other.

However, in such a conventional transfer apparatus, paper guided by the paper guide member is subjected to frictional resistance from guide surfaces of the two guide members of the paper guide member, so that the feeding cannot be performed smoothly. In addition, both surfaces of the paper are charged with electricity by friction to cause a state in which floating toner from a developing roller is apt to adhere to the paper to thereby make the paper dirty. Although it is therefore necessary to provide a measure to prevent such charging of electricity in the paper guide member, the charge preventing measure must be provided even on the guide member on the back surface side which is not related to the transfer surface of the paper, so that the structure is complicated and the cost is extremely high.

SUMMARY OF THE INVENTION

In order to solve the foregoing problems, an object of present invention is to provide a transfer apparatus in which the frictional resistance between a transfer material guide member and a transfer material is reduced enough so that the feeding of the transfer material can be performed smoothly, the structure is simplified to reduce the cost on a large scale, and a superior transferred image can be obtained.

A transfer apparatus according to the invention comprises: an image carrier having a transfer position; a feeding mechanism for feeding out a transfer material upward obliquely; and a transfer material guide member provided between the feeding mechanism and the image carrier and having a guide surface on a lower surface thereof to guide the transfer material to the transfer position along the guide surface.

In the transfer apparatus with such a configuration, the transfer material is guided by the single transfer material guide member, so that the structure is simplified. Moreover, since frictional resistance is produced only on one side of the transfer material, the feeding of the transfer material can be performed smoothly. In addition, the guide surface is formed on the lower surface of the transfer material guide member so as to guide the transfer material along this guide surface, so that the transfer material can be supplied to the transfer position of the image carrier stably.

DETAILED DESCRIPTION OF THE PREFERRED EMBODIMENT

An embodiment of the present invention will be described hereunder with reference to the accompanying drawings.

Figure 3:
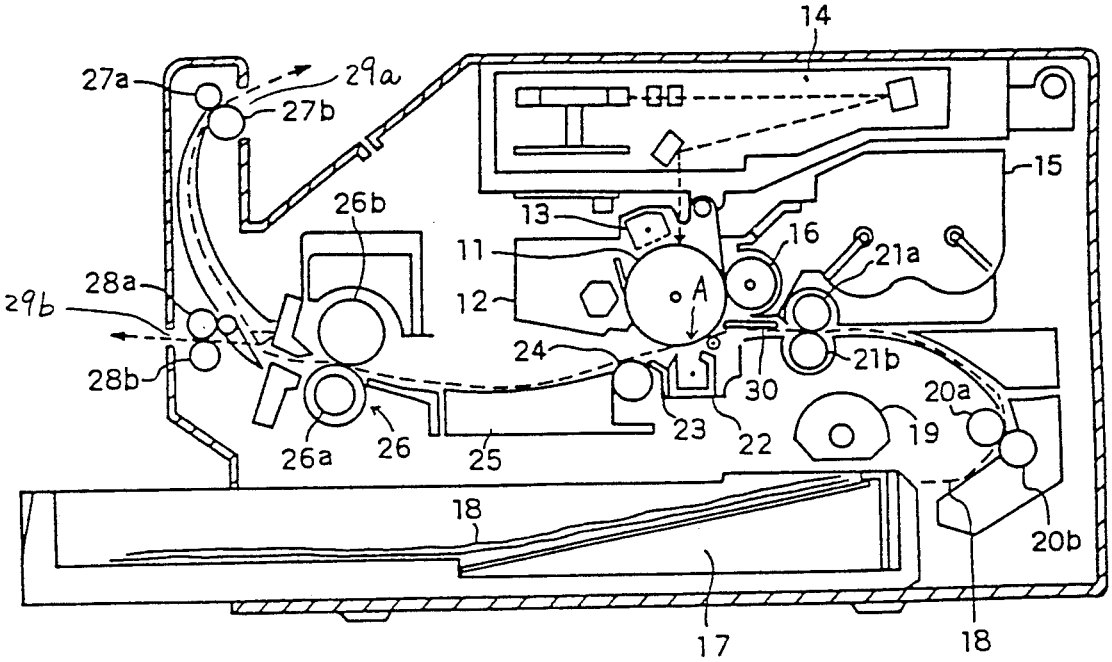
FIG. 3 is a schematic configuration diagram illustrating an image forming system using the embodiment of the transfer apparatus according to the present invention.

FIG. 3 shows a schematic configuration of an electrophotographic image forming system using an embodiment of the transfer apparatus according to the present invention. In this image forming system, a photoreceptor drum 11 as an image carrier is electrically charged uniformly by a charging corotron 13 provided on a PC cartridge 12, and then an electrostatic latent image is formed on the drum by an optical portion 14 such as a laser scanner. This electrostatic latent image is developed as a toner image with the developing bias applied by a developing roller 16 provided on a toner cartridge 15. On the other hand, paper 18 stored in a paper cassette 17 is extracted sheet by sheet from the paper cassette 17 by means of a separation mechanism including a semicircular roller 19, passed through a turn-feeding portion including feeding rollers **20*a* and 20*b*, and then temporarily stopped when the forward end of the paper comes in contact with the nip between feeding rollers 21*a* and 21*b* for making the forward end of the paper 18 agree with the forward end of a picture image. Thereafter, in timing, driven is a not-shown electromagnetic clutch for controlling the rotation of these feeding rollers 21*a* and 21*b*. As a result, the paper 18 is fed at a stable speed toward a transfer position A of the photoreceptor drum 11 along a guide surface 32 of a paper guide member 30 which will be described later. At the timing when the forward end of the paper 18 enters onto a transfer corotron 22 provided near the transfer position of the photoreceptor drum 11, a high voltage is applied to a wire of the transfer corotron 22. Consequently a toner image developed on the photoreceptor drum 11 is transferred onto the paper 18. Then the paper 18 on which the toner image has been transferred is discharged from the back surface side thereof by an erasure member or discharging member 23 provided on the downstream side of the transfer corotron 22 and separated at the same time from the photoreceptor drum 11. Then, the paper is led, by a feeding roller 24, to a fusing portion 26 along a feeding path 25. The fusing portion 26 is constituted by a heated roller 26*a*** and a pressing roller 26b. The heated roller 26a is controlled to be in a high and constant temperature, and the toner image on the paper is fused to the paper 18 in the nip between these rollers 26a and 26b. The paper 18 on which the toner image has been fused is discharged or ejected from a discharge port 29a or 29b by discharge rollers 27a and 27b or discharge rollers 28a and 28b depending on the use of the paper with the printed side of the paper downward or upward.

Figure 1:
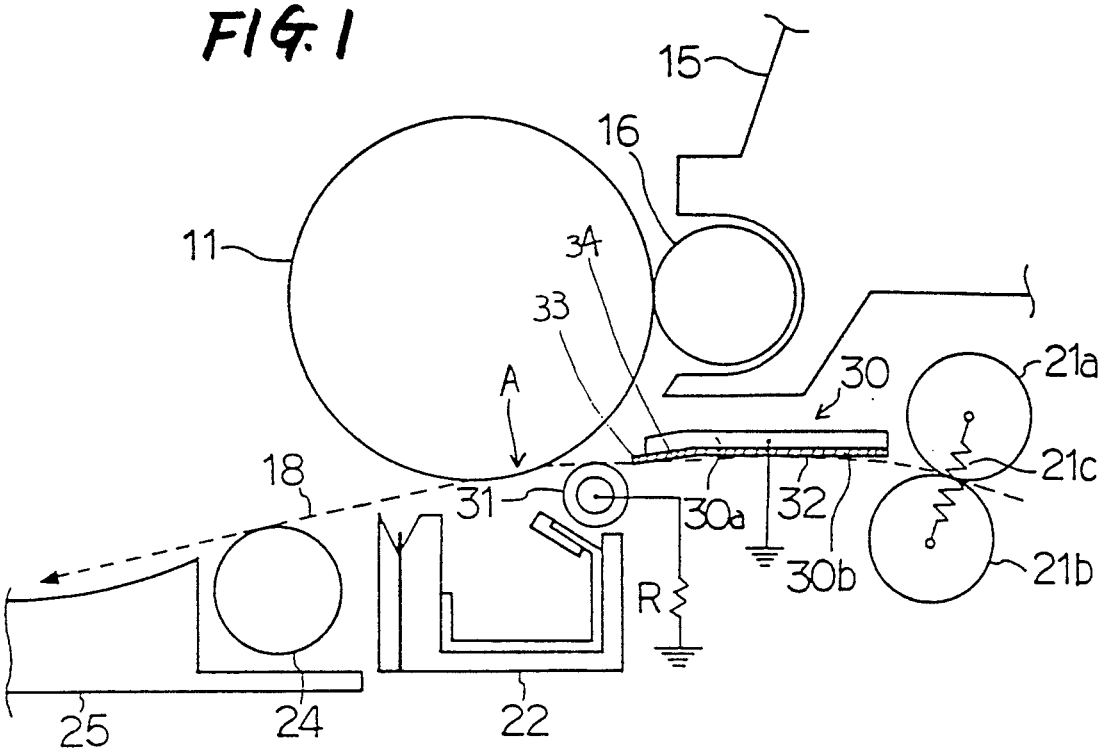
FIG. 1 is a schematic configuration diagram illustrating the neighborhood of an embodiment of the transfer apparatus according to the present invention.

FIG. 1 sectionally shows the configuration of the transfer apparatus taken out from the image forming system. In FIG. 1, the feeding rollers 21a and 21b in pair are so-called resist-rollers in which one feeding roller 21a is constituted by metal such as stainless steel and the other feeding roller 21b is constituted by an elastic member such as rubber. These feeding rollers 21a and 21b are urged against each other by means of a spring 21c so as to provide a paper feeding force. Of the feeding rollers 21a and 21b, the lower feeding roller 21b is positioned on the downstream side (in the paper feeding direction) of the upper feeding roller 21a so as to feed out the paper 18 upward obliquely. The paper guide member 30 for guiding the paper 18 is provided between the photoreceptor drum 11 and these feeding rollers 21a and 21b. A roller 31 for pressing the paper 18 against the surface of the photoreceptor drum 11 is provided between the paper guide member 30 and the transfer corotron 22. This roller 31 is constituted by a metal substance and a rubber layer formed on the surface of the metal substance. The roller 31 is supported above the transfer corotron 22 and the metal substance thereof is grounded through a resistor R of 100 MΩ.

The paper guide member 30 is constituted by a conductive substrate 30a and an insulator layer 30b fixed on the lower surface of the conductive substrate 30a. A guide surface 32 is formed on the surface of this insulator layer 30b so that the paper 18 is guided along this guide surface 32 toward the transfer position A of the photoreceptor drum 11. The transfer position A is established on the slightly upstream side of the lowest end portion of the photoreceptor drum 11.

The conductive substrate 30a of the paper guide member 30 is formed of metal, for example, iron in the form of a plate. This conductive substrate 30a is grounded. On the other hand, the insulator layer 30b is formed of insulating resin, for example, polyethylene terephthalate (abbreviated to "PET"), and the thickness thereof is selected to be, for example, about 0.1 mm. The volume specific resistance of this PET is $10^{16}$ Ω.cm, and the coefficient of friction is 0.18. At a high humidity, the paper 18 includes moisture so as to become conductive. In such a case, there is a problem in that if the paper 18 comes into contact with the conductive substrate 30a directly, positive charges of the transfer corotron 22 will escape through the paper 18 since the conductive substrate 30a is grounded, so that a transfer defect is caused. In order to prevent this defect, the insulator layer 30b is provided. The insulator layer 30b is projected over the end portion of the conductive substrate 30a on the photoreceptor drum 11 side by about 0.5 mm to 1 mm, and this projecting portion 33 not only prevents the paper 18 from contacting with the conductive substrate 30a, but also prevents floating toner falling from the developing roller 16 from adhering to the paper 18. In addition, the end portion of the paper guide member 30 on the photoreceptor drum 11 side is bent slightly in the form of an angle toward the transfer position A of the photoreceptor drum 11, so that the paper 18 is guided to the transfer position A along this bent portion 34.

In the transfer apparatus according to the present embodiment having such a configuration, a feeding force is applied to the paper 18 by the feeding rollers 21a and 21b, and the paper 18 is fed to the transfer position A of the photoreceptor drum 11 through the paper guide member 30. Then, since the lower feeding roller 21b is positioned on the downstream side of the upper feeding roller 21a, the forward end of the paper 18 is fed out toward the paper guide member 30 upward obliquely so as to be guided to the transfer position A along the guide surface 32 of this paper guide member 30.

In this transfer apparatus, since the paper 18 is guided by the single paper guide member 30, the number of parts is reduced into a half of that in a conventional transfer apparatus, so that the structure is simplified extremely. In addition, the frictional resistance of the paper guide member 30 is produced only against one surface (transfer surface) of the paper 18, so that the feeding of the paper 18 can be performed smoothly.

Further, the guide surface 32 is formed on the lower surface side of the paper guide member 30, and in addition thereto the angle-like bent portion 34 is formed in the forward end portion of this guide surface 32, so that it is possible to lead the paper 18 to the predetermined transfer position A stably. In addition, with such a configuration, the paper 18 comes to the photoreceptor drum 11 from the direction hardly receiving resistance against the curvature of the photoreceptor drum 11, i.e. along a reference plane that is nearly but just short of being tangential to the transfer position so that there is no fear that the photoreceptor drum is hurt. That is, if the paper guide member 30 were provided under the paper 18 so as to guide the paper 18 on the upper surface of the paper guide member 30, first the paper 18 would be pressed against the paper guide member 30 from above, and regulated upward thereat before reaching the transfer position A. In this case, the paper 18 would come to the transfer position A from below so that the forward end of the paper 18 might be shifted to cause a transfer defect. In addition, the paper 18 would come the photoreceptor drum 11 at an angle easy to receive resistance against the curvature of the photoreceptor drum 11, so that there might be a possibility of damaging the photoreceptor drum 11. On the contrary, in the case of the transfer apparatus according to the present embodiment, the paper guide member 30 is provided above the paper 18, and the guide surface 32 is formed on the lower surface side of the paper guide member 30. Therefore, the paper comes to the transfer position A of the photoreceptor drum 11 from above, so that there is no problem as described above. That is, the path of the paper draws an ideal gentle parabola.

In addition, in the transfer apparatus according to the present embodiment, the paper guide member 30 is constituted by the conductive substrate 30a and the insulator layer 30b formed of PET and bonded on the lower surface side of the conductive substrate 30a. With such a configuration, the frictional resistance of the insulator layer 30b is so small that the feeding of the paper 18 can be performed smoothly. When the paper 18 is guided by the paper guide member 30, an electric field is formed between the conductive substrate 30a, the insulator layer 30b and the paper 18. Therefore, even if charges (positive charges) are produced by the friction between the paper 18 and the insulator layer 30*b*, the charges are canceled by charges (negative charges) produced in the grounded conductive substrate 30*a*, so that the paper 18 is not charged. Consequently, a blot of an image called fuzzy or blur can be improved. In addition, since the insulator layer 30*b* is not charged, the paper hardly receives an influence of excessive charges beyond a necessary quantity of charges for transferring by the corona discharge by means of the transfer corotron 22. Therefore, so-called transfer missing is not produced, so that superior transfer can be carried out. In addition, the projecting portion 33 is provided On the insulator layer 30*b* so as to project over the end portion of the conductive substrate 30*a* on the photoreceptor drum 11 side, so that even if there is floating toner from the developing roller 16, there is no fear that the floating toner adheres to the paper 18 concentrately.

Generally, in order to obtain a superior transfer image, it is desirable that the roller 31 above the transfer corotron 22 together with the paper guide member 30 are put as close to the transfer position A of the photoreceptor drum 11 as possible. The transfer position A depends on the positions of the roller 31 and the paper guide member 30. That is, if the roller 31 and the paper guide member 30 were too far from the photoreceptor drum 11, the rear end of the paper 18 would be jumped up immediately after leaving the paper guide member 30, so that the paper 18 which was being subjected to image transfer would vibrate out of its ideal path for a moment, thereby causing an image defect called a so-called a defect phenomenon (phenomenon that a black belt appears as a transversal line). In the transfer apparatus according to the present embodiment, the roller 31 is supported above the transfer corotron 22, and the quantity of floating toner adhering to the paper guide member 30 can be reduced as has been described above, so that the paper guide member 30 and the roller 31 can be made to approach the transfer position A up to such a degree (within 4 mm) that the defect phenomenon is never produced, thereby to obtain a superior transfer image.

Actually, when the paper was fed to perform transferring by the transfer corotron 22, no floating toner adhered to the paper 18, and no stain was produced. Even in a condition of low humidity easy to produce a stain, no stain was produced on the paper 18, and further in a condition of high humidity no transfer missing was produced, so that a superior transfer image could be obtained.

As the insulator layer 30*b*, PET as mentioned in the above embodiment is preferable, but any material having characteristics equivalent to this may be used in the same manner. For example, as shown in Table 1, it is possible to use polycarbonate, high density polyethylene, ABS resin, vinyl chloride, polypropylene, polyacetal, etc. each having a volume specific resistance in a range of from $1\times10^{15}$ to $1\times10^{16}$ Ω.cm. Particularly preferable are high density polyethylene and vinyl chloride each having a frictional coefficient close to that of PET. As for ABS resin and polyacetal each having a frictional coefficient almost the same as that of PET, there is no ABS resin and polyacetal in the form of a 0.1 mm sheet, so that it is necessary to make a coating on the conductive substrate 30*a* to form the insulating layer 30*b*.

TABLE 1

| | volume specific resistance (Ω · cm) | frictional coefficient |
|---|---|---|
| polycarbonate | $1 \times 10^{16}$ | 0.35 |
| high density polyethylene | $1 \times 10^{16}$ | 0.14 |
| ABS resin | $1 \times 10^{16}$ | 0.18 |
| vinyl chloride | $1 \times 10^{15}$ | 0.25 |
| polypropylene | $1 \times 10^{16}$ | 0.37 |
| polyacetal | $1 \times 10^{15}$ | 0.17 |

Figure 2:
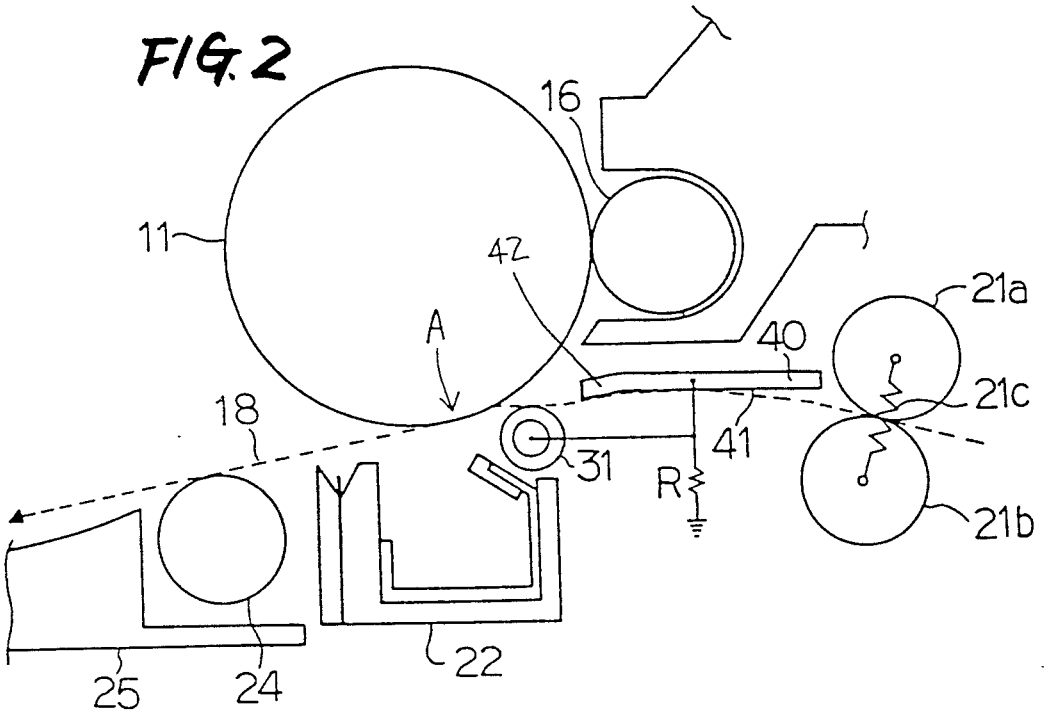
FIG. 2 is a schematic configuration diagram illustrating the neighborhood of another embodiment of the transfer apparatus according to the present invention.

FIG. 2 shows another embodiment according to the present invention. In this embodiment, a paper guide member 40 is formed of metal, for example, iron, and a guide surface 41 is formed on the lower surface side of the paper guide member 40. In addition to this, the forward end portion of the paper guide member 40 on the photoreceptor drum 11 side is bent in the form of an angle or a bent portion 42. This paper guide member 40 is grounded together with a roller 31 through a resistor R of 100 MΩ. The configuration of other parts is the same as that of the embodiment in FIG. 1, so that the description thereof will be omitted.

In this transfer apparatus, the paper 18 fed through feeding rollers 21*a* and 21*b* is guided to the transfer position A of the photoreceptor drum 11 along the guide surface 41 on the lower surface side of the paper guide member 40.

In this transfer apparatus, similarly to the configuration of the transfer apparatus of FIG. 1, the paper 18 is guided by the single paper guide member 40 so that the number of parts is reduced into a half of the conventional transfer apparatus in the same manner as the transfer apparatus of FIG. 1, and in addition to this, a charge prevention measure such as high resistance grounding by use of an erasure or discharge brush or application of a bias can be omitted, so that the structure is simplified extremely. In addition, since the frictional resistance of the paper guide member 40 is produced only on one side (transfer side) of the paper 18, the feeding of the paper 18 can be performed smoothly. In addition, since the guide surface 41 is formed on the lower surface side of the paper guide member 40, it is possible to lead the paper 18 to the predetermined transfer position A stably, and since the paper 18 is led to come to the photoreceptor drum 11 from the direction hardly receiving resistance against the curvature of the photoreceptor drum 11, there is no fear of damaging the photoreceptor drum. Also in the transfer apparatus of this embodiment, since the roller 31 is supported above the transfer corotron 22, the paper guide member 40 can be made to approach the transfer position A in comparison with the conventional one, thereby to obtain a superior transfer picture image.

As has been described, according to the invention, the configuration is made such that a transfer material such as paper is guided by a single transfer material guide member, so that the structure is simplified extremely and it is therefore possible to expect to reduce the cost on a large scale. In addition, since frictional resistance is produced only on one side of the transfer material, the feeding of the transfer material can be performed smoothly. Moreover, a guide surface is formed on the lower surface side of the transfer material guide member so as to guide the transfer material along this guide surface, so that the transfer material can be supplied to a transfer position of an image carrier stably, and in addition thereto there is no possibility of damaging the image carrier.

What is claimed is:

1. A transfer apparatus comprising:

a rotatable image carrier having an image carrying surface for which an image transfer position is defined;

means for feeding a transfer material obliquely upward along a predetermined general direction that is generally toward said image transfer position and generally in the direction of carrier rotation;

means for guiding said transfer material from said feeding means along the predetermined general direction;

said guiding means being located between said feeding means and said image carrier and above said image carrier transfer position;

said guiding means having a downwardly facing guide surface extending along the predetermined general direction and against which said transfer material is urged as a result of its oblique upward feed thereby to be guided without underside support along the predetermined general direction toward said image carrier surface generally in the direction of carrier rotation; and said guiding means having an end portion from which said transfer material exits downwardly to enter said image transfer position along a reference plane at least tangential to said image transfer position.

2. A transfer apparatus according to claim 1, in which said guiding means includes a guide member constituted by a conductive substrate and an insulator layer formed on a surface of said conductive substrate, a surface of said insulator layer forming said downwardly facing guide surface.

3. A transfer apparatus according to claim 2, in which toner developer means is provided adjacent said carrier and above said guide member, and at least a part of said insulator layer of said guide member projects over an end portion of said conductive substrate on said image carrier side.

4. A transfer apparatus according to claim 1, in which said guide means is constituted by a conductive member and grounded through a resistor.

* * * * *